US006238298B1

(12) United States Patent
Chen

(10) Patent No.: US 6,238,298 B1
(45) Date of Patent: May 29, 2001

(54) AIMING DEVICE FOR GOLF PUTTER

(76) Inventor: David Chen, 9F-1, No. 629, Sec. 1, Chung Teh Road, Taichung (TW)

( * ) Notice: Subject to any disclaimer, the term of this patent is extended or adjusted under 35 U.S.C. 154(b) by 0 days.

(21) Appl. No.: 09/369,374

(22) Filed: Aug. 6, 1999

(51) Int. Cl.[7] ..... A63B 69/36
(52) U.S. Cl. ..... 473/220
(58) Field of Search ..... 473/219, 220, 473/221, 222, 223, 226, 227, 242, 131, 199, 268; 362/102, 234, 250, 259

(56) References Cited

U.S. PATENT DOCUMENTS 3,106,403 * 10/1963 Kirkman .
3,820,795 * 6/1974 Taylor .
5,207,429 * 5/1993 Waimsley .
5,213,331 * 5/1993 Avanzini .
5,388,831 * 2/1995 Quadri .
5,464,221 11/1995 Carney .
5,464,222 11/1995 Carney .
5,465,972 * 11/1995 Cornett .
5,467,991 * 11/1995 White .
5,494,290 2/1996 Stefanoski .
5,611,739 3/1997 Carney .
5,692,965 * 12/1997 Nighan .
5,693,041 * 12/1997 Murphy-Chutorian .
5,707,296 1/1998 Hodgson et al. .
5,725,440 3/1998 Finney .
5,788,588 * 8/1998 Hooker .
5,897,200 * 4/1999 Ho .
5,964,668 * 10/1999 Tai .

* cited by examiner

*Primary Examiner*—Sebastiano Passaniti
(74) *Attorney, Agent, or Firm*—Browdy & Neimark

(57) ABSTRACT

An aiming device for a golf putter comprises a holding member, a main body, a locating member, a laser member, a switch, and a power source. The device is detachably fastened with the shaft or grip of the golf putter by the holding member. The main body is fastened pivotally with the holding member in conjunction with the locating member. The laser member is disposed in the main body and is capable of projecting an aiming line on a projection surface. The laser member is provided with power by the power source which is located in the main body. The laser member is turned on or off by the switch.

12 Claims, 11 Drawing Sheets

AIMING DEVICE FOR GOLF PUTTER

FIELD OF THE INVENTION

The present invention relates generally to a golf accessory, and more particularly to an aiming device for a putter.

BACKGROUND OF THE INVENTION

The U.S. Pat. No. 5,494,290 discloses a golf putter handle which is provided with a laser member, a through hole, and a control button. The through hole is provided respectively in the inside thereof and in the outside thereof with a reflector under which a round reflector is disposed. The handle is provided with a battery. In operation, when the control button is pressed, an aiming line is projected on the head such that the aiming line is perpendicular to the ball striking surface of the head. Such an aiming device as described above must be purchased along with a golf putter and is rather expensive.

The U.S. Pat. No. 5,611,739 discloses a putter which is provided in a head thereof with an aiming device capable of emitting an aiming line perpendicular to the ball-striking surface. The aiming device is sold separately and can be detachably fastened with the putter. The drawback of the aiming device is that it is visible to a golfer using the putter. In addition, the aiming device gives an added weight to the putter head.

The U.S. Pat. No. 5,725,440 discloses a putter which is provided in the grip thereof with a cavity in which a laser pen is disposed. The putter shaft is provided in the bottom end thereof with a reflector capable of reflecting light at right angle so as to form an aiming line. The putter is expensive.

The U.S. Pat. No. 5,707,296 discloses a putter head which is provided at two ends thereof with a laser member. The two laser members emit two aiming lines parallel to each other. The putter is expensive and can not be used in a tournament.

The U.S. Pat. Nos. 5,464,221 and 5,464,222 disclose respectively a putter which is provided in the juncture of the head thereof and the shaft thereof with a laser member for emitting an aiming line. The putter is not cost-effective and is used for practice only. In addition, the aiming line emitted by the laser member is fuzzy.

SUMMARY OF THE INVENTION

The primary objective of the present invention is to provide a golf putter with an aiming device which can be fastened with the shaft or the grip of the golf putter for projecting a clear aiming line on the green.

It is another objective of the present invention to provide a golf putter with an aiming device which is relatively small in size.

In keeping with the principle of the present invention, the foregoing objectives of the present invention are attained by an aiming device comprising a holding member, a main body, a locating member, a laser member, a switch, and a power source. The device is fastened with the shaft or grip of a golf putter by the holding member. The main body is fastened pivotally with the holding member in conjunction with the locating member. The laser member is disposed in the main body and is capable of forming an aiming line on a projection surface. The laser member is provided with power by the power source which is located in the main body. The laser member is turned on or off by the switch.

DETAILED DESCRIPTION OF THE INVENTION

Figure 1:
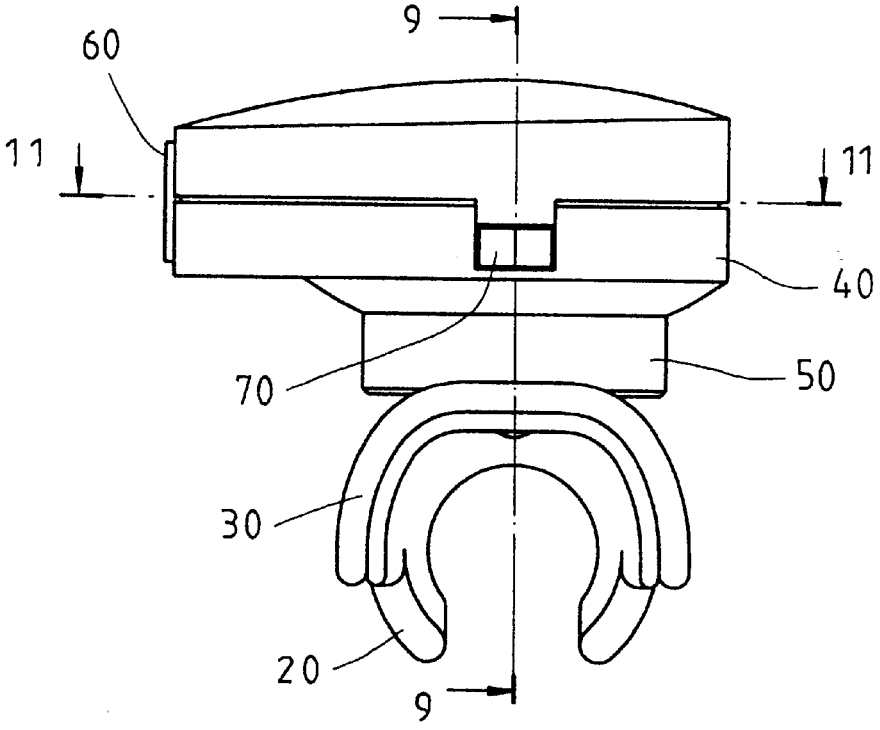
FIG. 1 shows a front view of a preferred embodiment of the present invention.

As shown in FIGS. 1–4, an aiming device embodied in the present invention is intended for a golf putter and is essentially composed of a holding member 20, a main body 40, a locating member 50, a laser member 60, a switch 70, and a power source 90.

Figure 2:
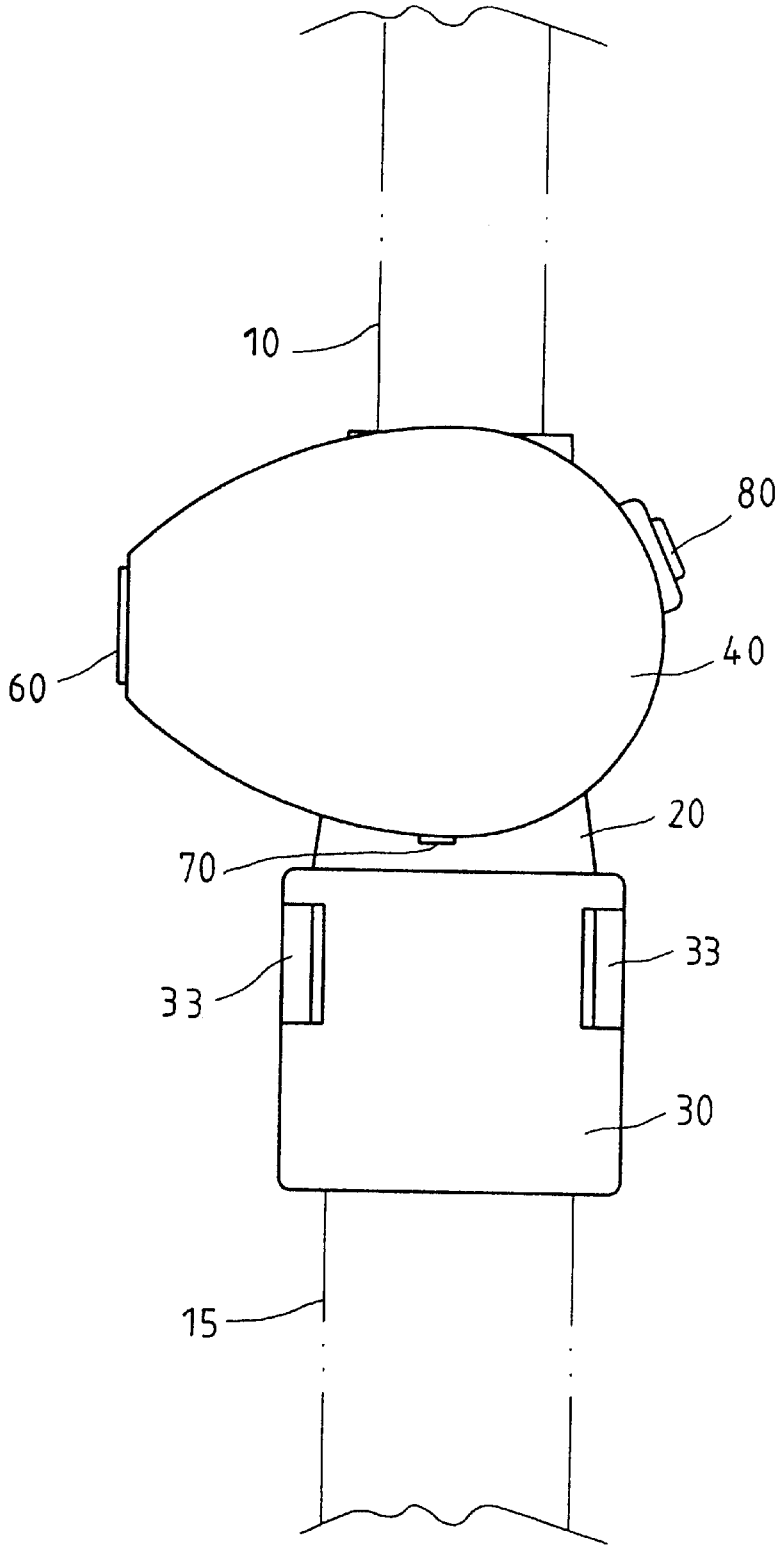
FIG. 2 shows a top view of the preferred embodiment of the present invention.
Figure 5:
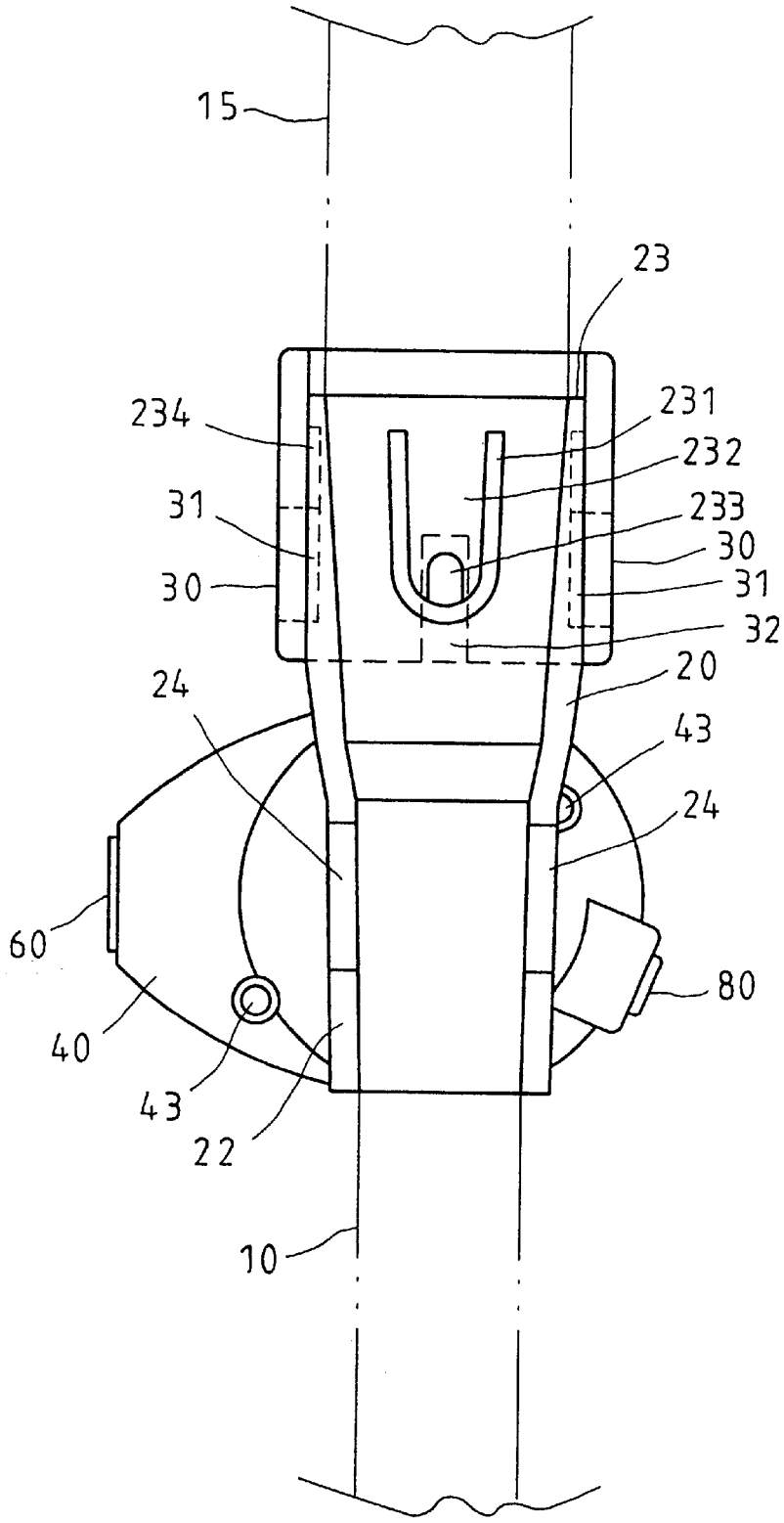
FIG. 5 shows a bottom view of the preferred embodiment of the present invention.

The holding member 20 is detachably fastened with a putter shaft 10 or grip 15, as indicated by the dotted lines in FIGS. 2, and 5. In the preferred embodiment of the present invention, the holding member 20 is fastened with a portion contiguous to the putter shaft 10 and the putter grip 15, as shown in FIG. 5. The holding member 20 is located by a retaining member 30. The holding member 20 is provided with a pivoting column 27.

The main body 40 is fastened pivotally with the pivoting column 27 such that the main body 40 is capable of turning on pivoting column 27.

The locating member 50 is used to locate securely the main body 40 on the pivoting column 27.

Figure 13:
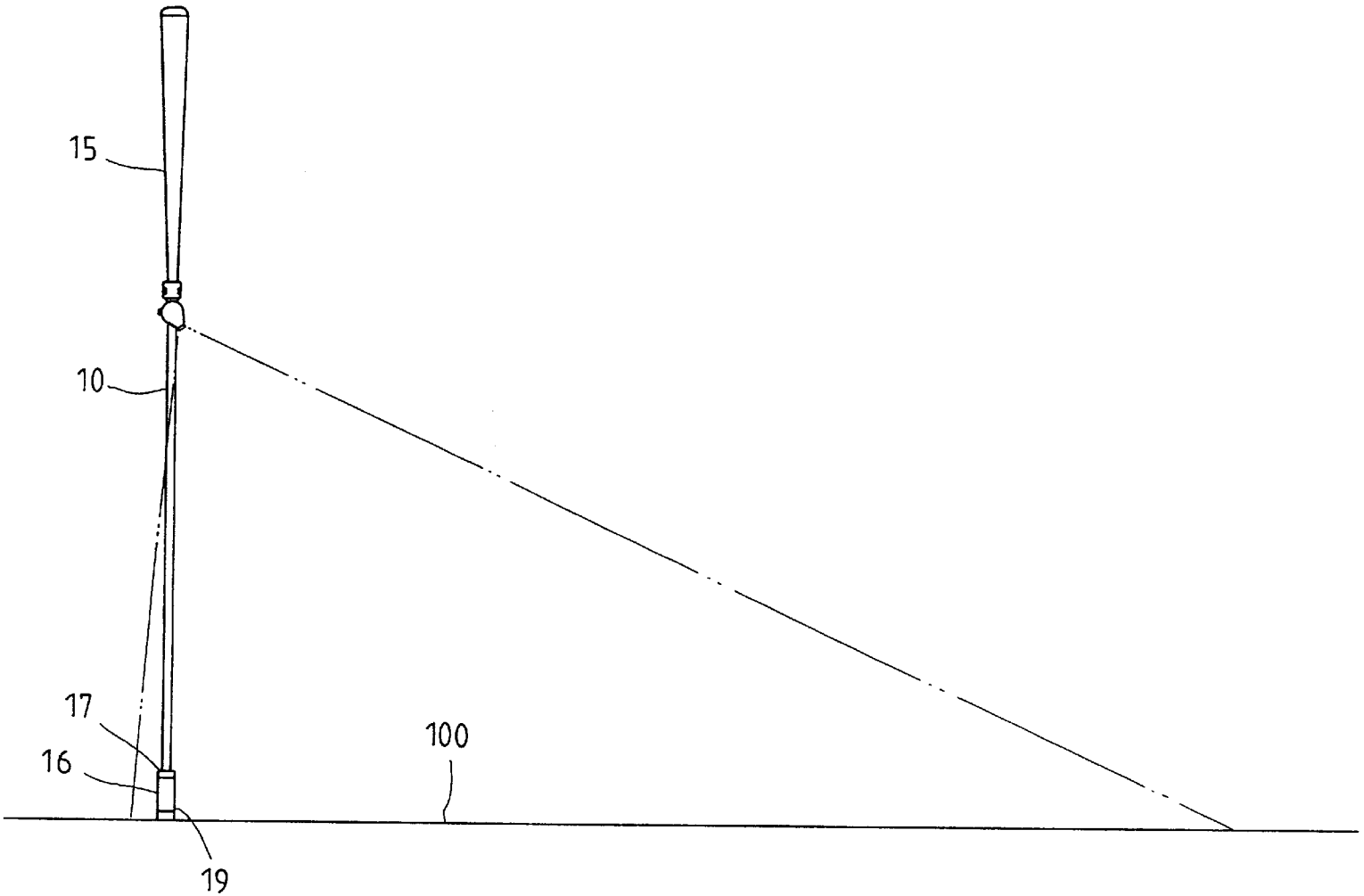
FIG. 13 shows a schematic view of the preferred embodiment of the present invention at work.
Figure 14:
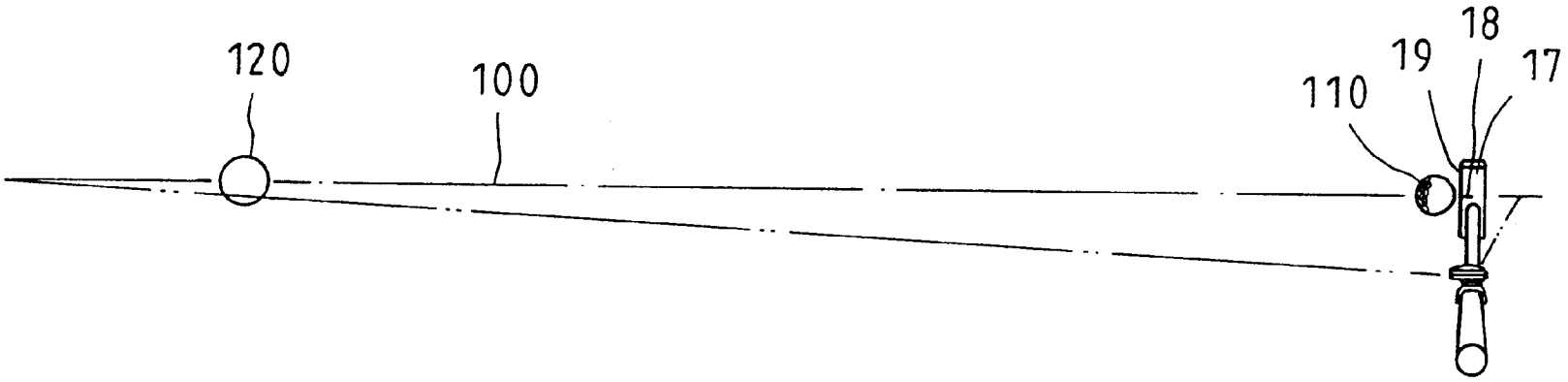
FIG. 14 shows another schematic view of the preferred embodiment of the present invention at work.

The laser member 60 is disposed in the main body 40 for emitting an aiming line 100 on a projection surface, as shown is FIGS. 13 and 14.

The switch 70 is fastened with the main body 40 for turning the laser member 60 on or off. A press button 80 is fastened with the main body 40 for starting the laser member 60.

The power source 90 is located in the main body 40 for providing the laser member 60 with power.

As shown is FIGS. 3, 4, 5, and 9, the holding member 20 is provided with an axial hole 21 extending along the direction of a longitudinal axis of the holding member 20 and having a C-shaped cross section, a small diametric end 22, and a large diametric end 23. Now referring to FIGS. 4 and 5, the small diametric end 22 is provided in the middle thereof with two cuts 24, each being provided in the top thereof and the bottom thereof with a holding portion 25 (26) for embracing the shaft 10 or grip 15.

Figure 4:
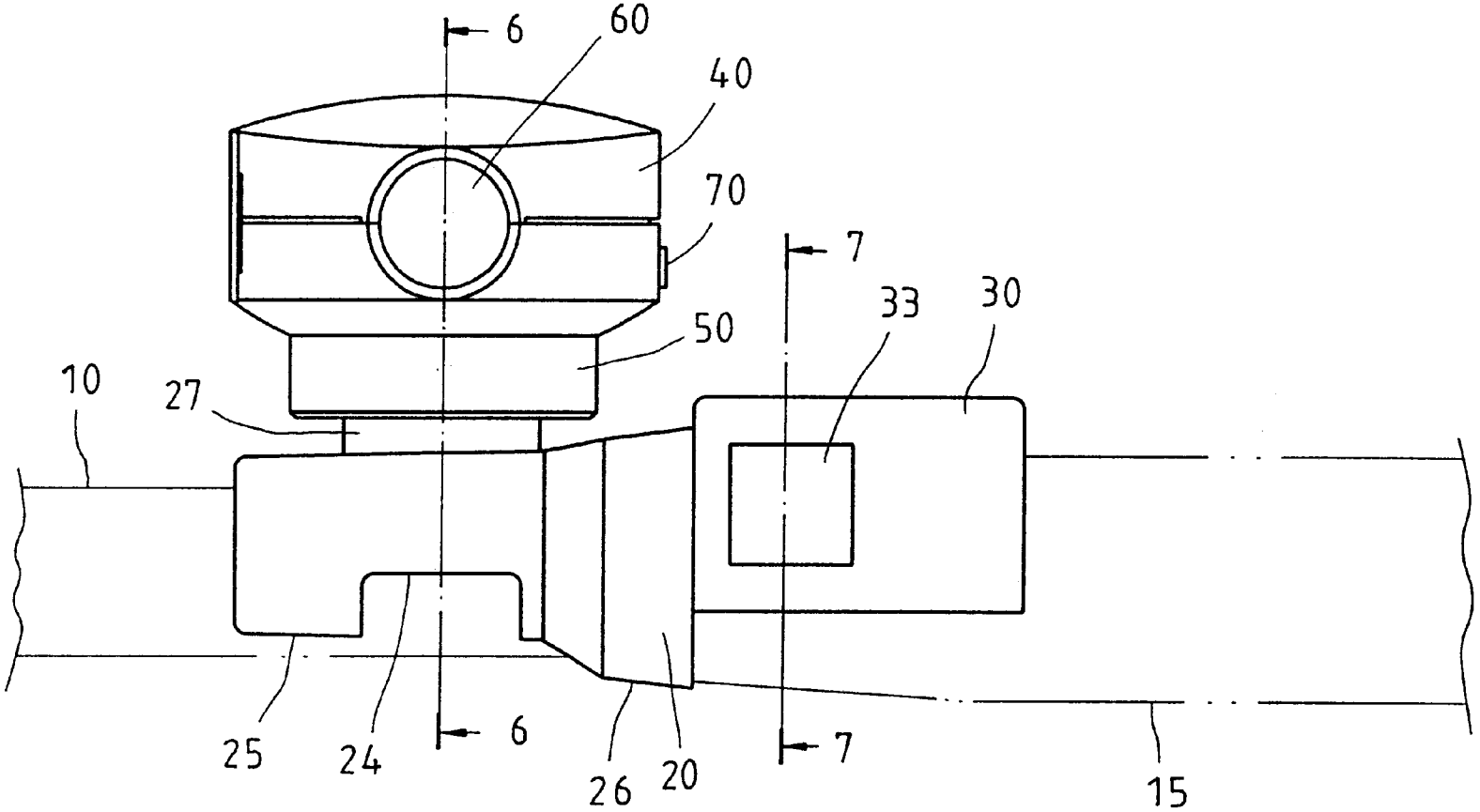
FIG. 4 shows a left view of the preferred embodiment of the present invention.
Figure 7:
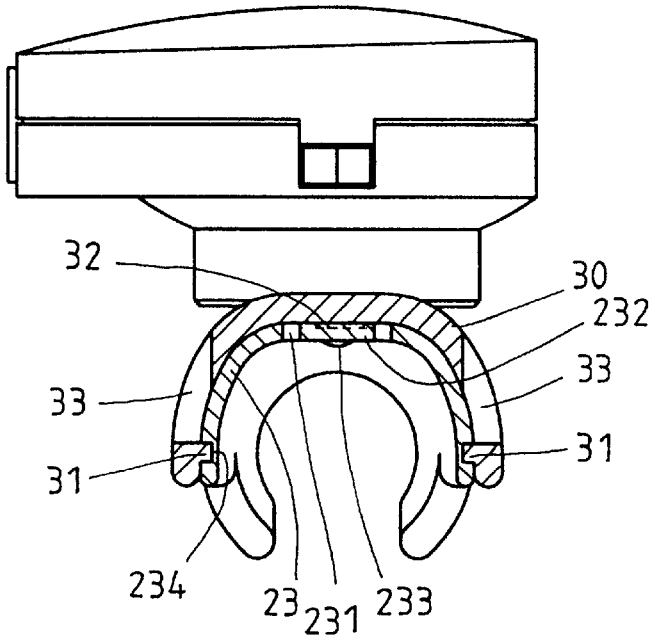
FIG. 7 shows a sectional view of a portion taken along the direction indicated by a line 7—7 as shown in FIG. 4.
Figure 9:
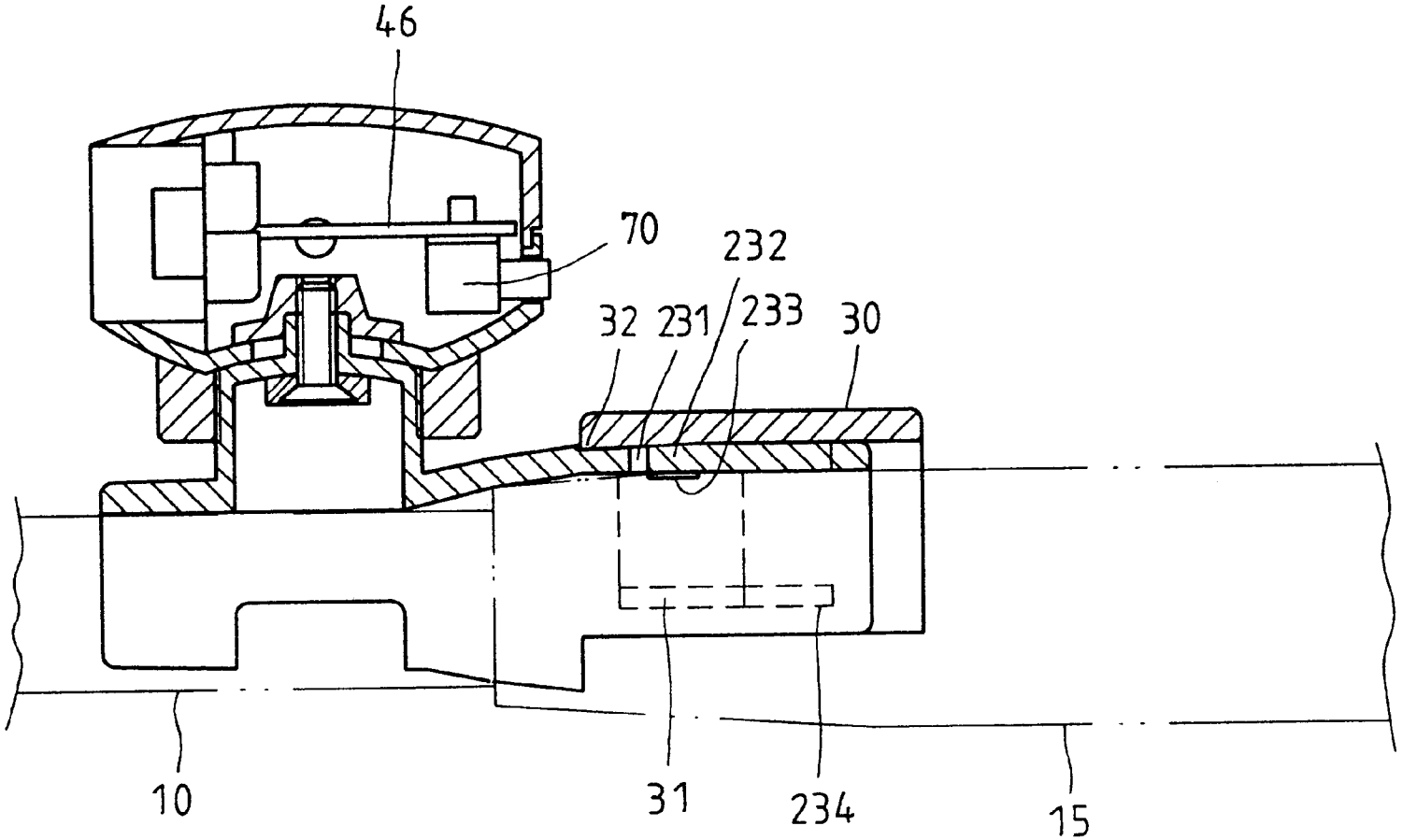
FIG. 9 shows a sectional view of a portion taken along the direction indicated by a line 9—9 as shown in FIG. 1.
Figure 10:
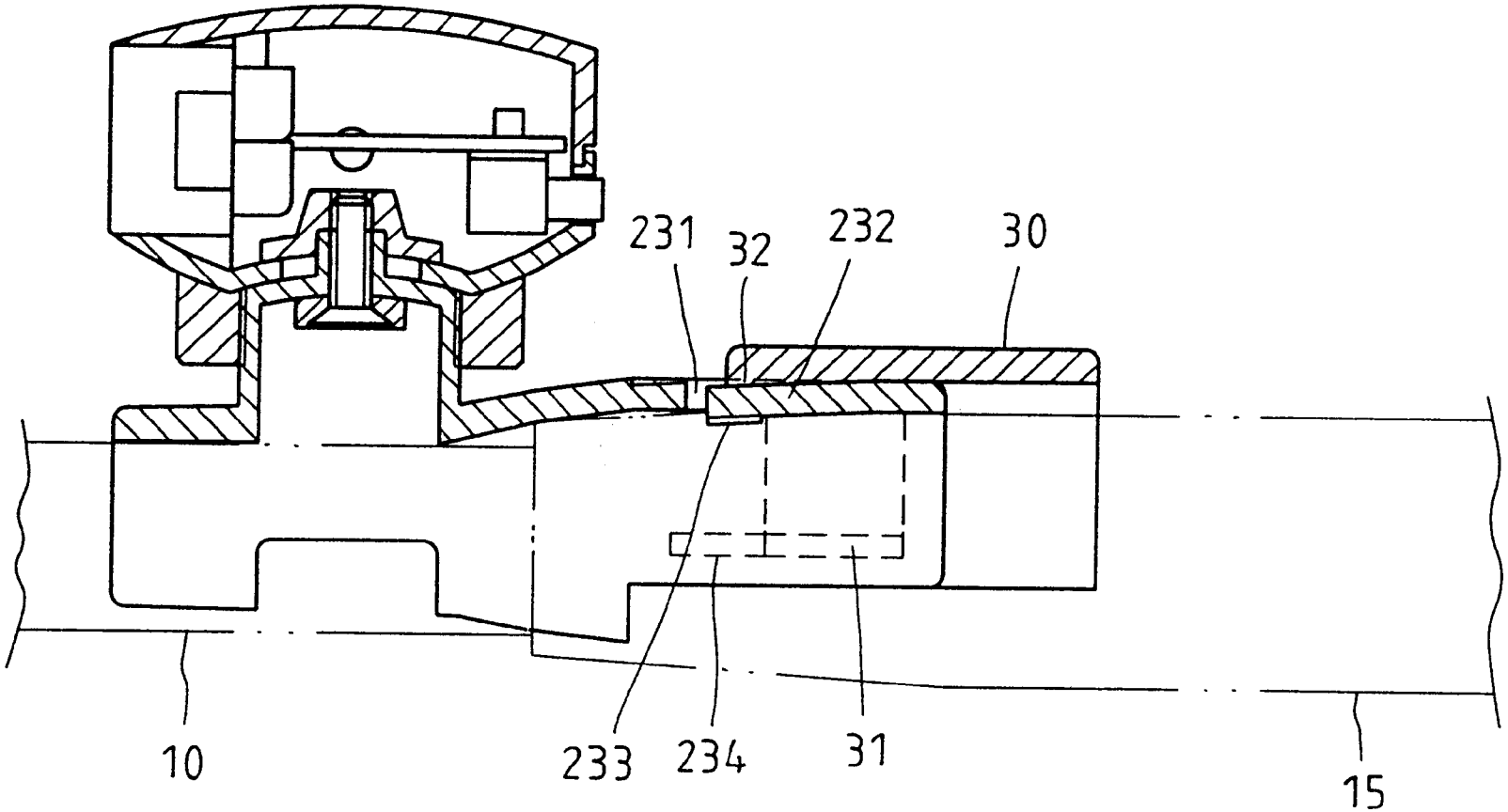
FIG. 10 is a sectional view similar to FIG. 9 to show the locating state of a retaining member of the present invention.

As shown in FIGS. 5, 7, and 9, the large diametric end 23 of the holding member 20 is provided in the center of the C-shaped wall thereof with a U-shaped slot 231 which is in turn provided with a pliable portion 232. The pliable portion 232 has a free end extending forward the small diametric end 22. The free end is provided in the bottom thereof with a retaining projection 233. The large diametric end 23 is provided in both sides of the C-shaped wall thereof with a recess 234. The retaining member 30 has a C-shaped cross section for embracing securely the large diametric end 23 of the holding member 20. The retaining member 30 is provided with two arms 31 corresponding in location to the two recesses 234. The arms 31 are movably located in the recesses 234 such that the arms 31 are capable of sliding along the recesses 234. The retaining member 30 is further provided with a wedge-shaped protrusion 32, as shown in FIGS. 9 and 10. The wedge-shaped protrusion 32 is corresponding in location to the pliable portion 232. The retaining member 30 is further provided with two grooves 33 corresponding in location to the two arms 31, as shown in FIGS. 2, 4, and 7. Now referring to FIG. 9, when the holding member 20 is secured to a golf putter, the retaining member 30 is located at an inner check point nearest the main body 40 such that the wedge-shaped protrusion 32 of the retaining member 30 does not urge the pliable portion 232 of the holding member 20. The user's thumb or index finger is retained in the groove 33, as shown in FIG. 10, such that the retaining member 30 is moved toward the right side of the drawing to locate to the outermost outer check point. As a result, the pliable portion 232 of the holding member 20 is urged by the wedge-shaped protrusion 32 of the retaining member 30 to curve so as to press against the grip 15. The holding member 20 is thus securely held on the grip 15.

Figure 6:
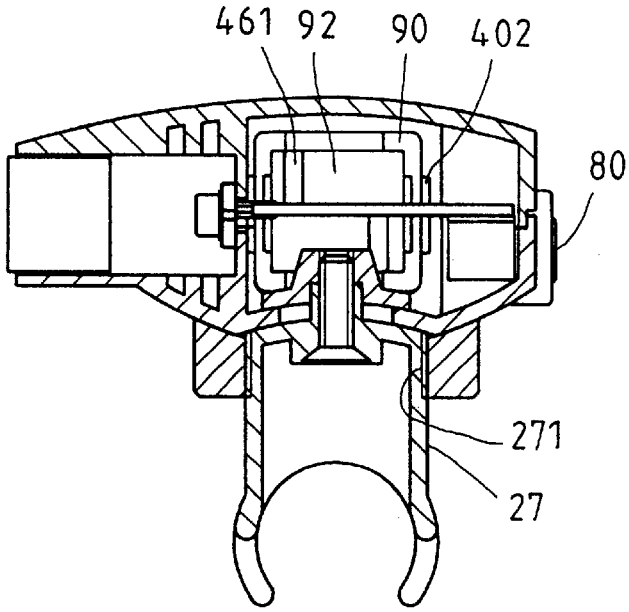
FIG. 6 shows a sectional view of a portion taken along the direction indicted by a line 6—6 as shown in FIG. 4.
Figure 8:
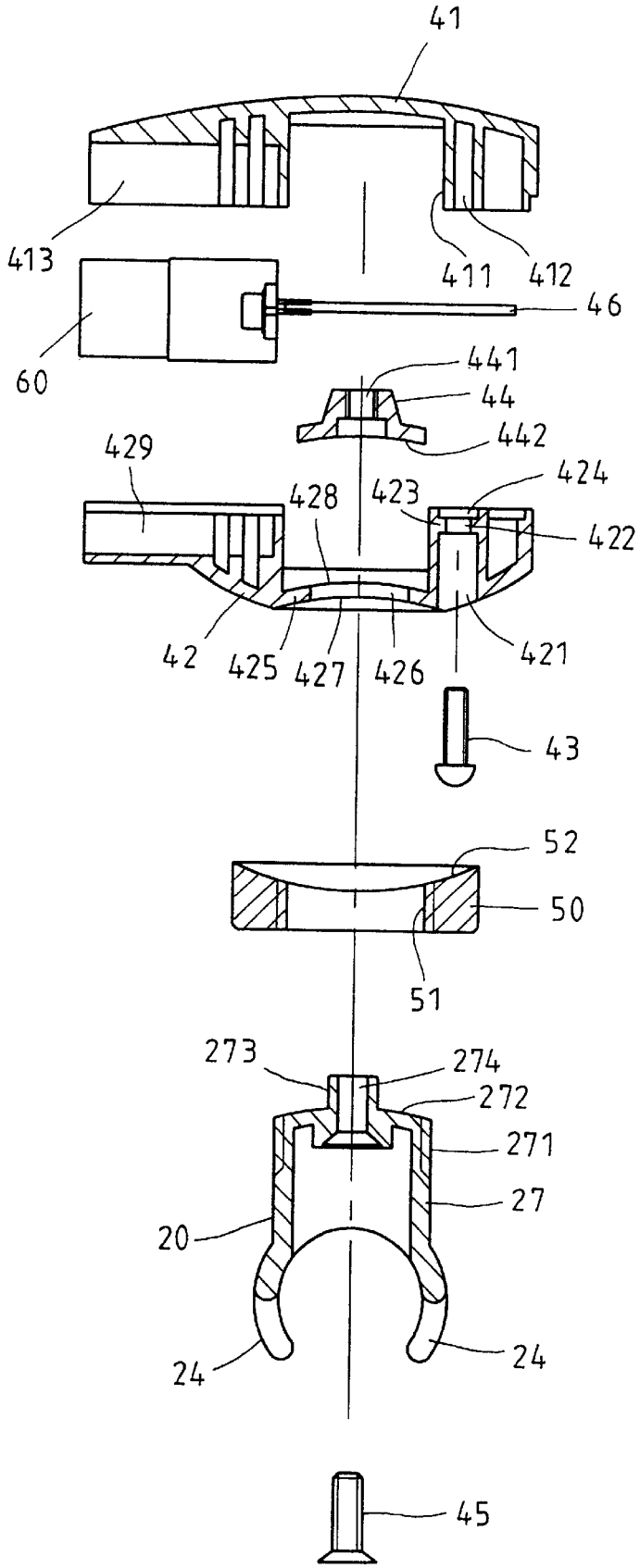
FIG. 8 shows an exploded view of the preferred embodiment as shown in FIG. 6.

As shown in FIGS. 4, 6, and 8, the pivoting column 27 of the holding member 20 is provided with outer threads 271, an arcuate top 272, and a pillar 273 which is provided in the center thereof with a through hole 274. The locating member 50 is provided with a threaded hole 51 which is engaged with the outer threads 271 of the pivoting column 27 of the holding member 20, as shown in FIG. 8. The locating member 50 is provided with an arcuate recess 52. The main body 40 is formed of an upper shell 41 and a lower shell 42, which are fastened together by two fastening bolts 43, as shown in FIG. 5. Now referring to FIG. 8, the lower shell 42 is provided in the right side thereof with a cavity 421 which is provided in the center of the bottom wall thereof with a through hole 422 and a shoulder 423 surrounding the through hole 422. Located over the shoulder 423 is a slot 424. The upper shell 41 is provided in the right side thereof with a columnar body 411 which is inserted at the bottom end thereof into the slot 424 and is provided at the center of the underside thereof with an axial hole 412 in which the fastening bolt 43 is received via the cavity 421 and the through hole 422, so as to fasten the upper shell 41 and the lower shell 42 together. The lower shell 42 is provided at the bottom thereof with an arcuate receiving portion 425 which is in turn provided at the center thereof with a through hole 426. The receiving portion 425 is provided in the outer wall thereof with an arcuate recess 427, and in the inner wall thereof with an arcuate protrusion 428. The pillar 273 of the pivoting column 27 is put through the through hole 426 of the lower shell 42 such that the arcuate recess 427 is in contact with the arcuate top 272. A locking member 44 is provided with a threaded hole 441 and an arcuate recess 442 in contact with the arcuate protrusion 428 of the lower shell 42. The main body 40 is fastened pivotally with the pivoting column 27 by a fastening bolt 45 which is engaged with the threaded hole 441 of the locking member 44 via the through hole 274. The through hole 426 of the main body 40 is greater in the outer diameter than the pillar 273. The main body 40 is capable of turning on the pillar 273 for 360 degrees. In light of the arcuate top 272, the arcuate recess 427, the arcuate protrusion 428, and the arcuate recess 442 being equal to one another in curvature radius, the main body 40 can be obliquely adjusted up and down. After the angular adjustment of the main body 40, the locating member 50 is rotated upwardly such that the arcuate recess 52 urges the lower shell 42 of the main body 40.

Figure 3:
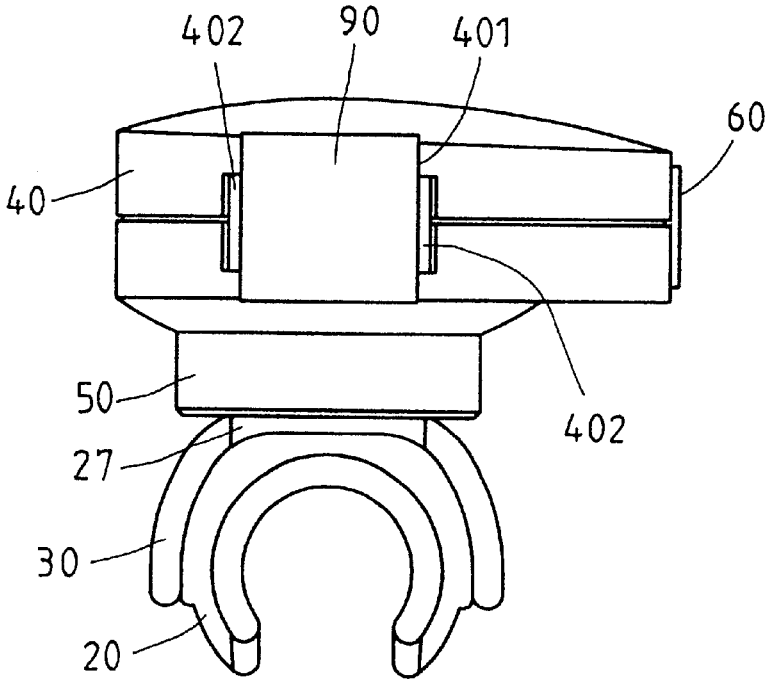
FIG. 3 shows a rear view of the preferred embodiment of the present invention.
Figure 11:
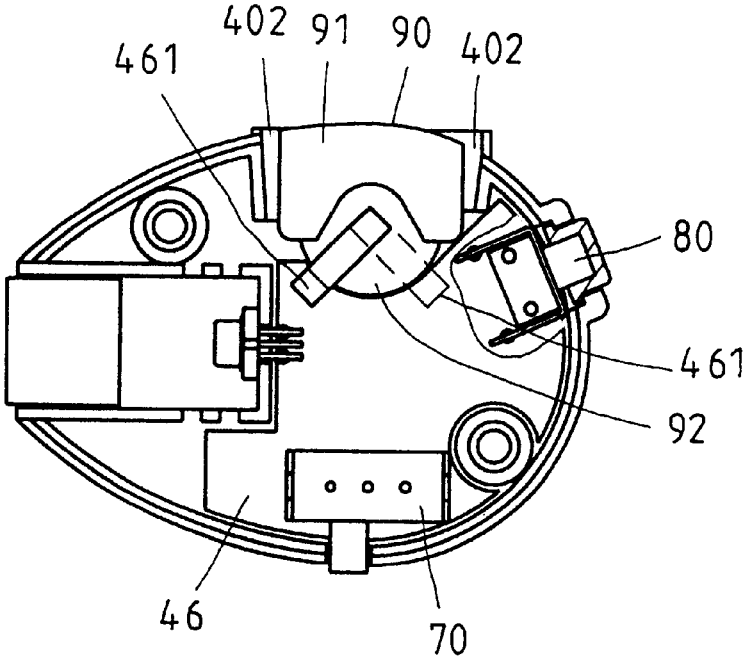
FIG. 11 shows a sectional view of a portion taken along the direction indicated by a line 11—11 as shown in FIG. 1.
Figure 12:
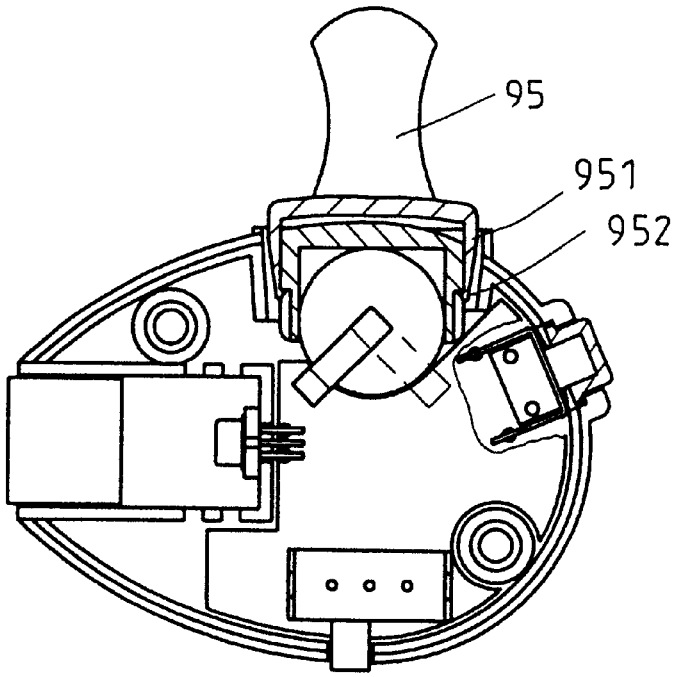
FIG. 12 is a sectional view similar to FIG. 11 to show the holding of a battery case by a clamping device.

As shown is FIGS. 6 and 8, the laser member 60 is disposed in the slot 413 of the upper shell 41 and the slot 429 of the lower shell 42. The laser member 60 is provided with a mirror for projecting a straight aiming line 100 toward a projection surface, which is the golf green. This is a prior art technique and is not the subject matter of the present invention. Now referring to FIGS. 8, 9, and 11, the main body 40 is further provided with a circuit board 46, which is connected with the circuit of the laser member 60, the switch 70, and the press button 80. The power source 90 comprises a battery case 91, and two mercury batteries 92 which are held in the battery case 91. The battery case 91 is received in the receiving slot 401 of the main body 40, as shown in FIG. 3. The mercury batteries 92 are partially jutted out of the battery case 91 so as to facilitate the connection of the mercury batteries 92 with two conductive pieces 461 of the circuit board 46. The battery case 91 can be taken out by a clamp 95 for replacing the old batteries with new ones, as illustrated in FIG. 12. The receiving slot 401 of the main body 40 is provided in two sides thereof with a depression 402. The battery case 91 is provided in two sides thereof with a slot 911. The clamp 95 has two parallel support arms 951 which are inserted into the two depressions 402 of the main body 40. The clamp 95 is provided with an inverted hook 952 for catching the two slots 911 to facilitate the removing of the battery case 91.

As shown in FIGS. 13 and 14, the holding member 20 of the present invention embraces securely the juncture of the shaft 10 and the grip 15. The holding member 20 is reinforced by the retaining member 30. As soon as the switch 70 is turned on, an aiming line 100 is projected by the laser member 60 on the green. By loosening the locating member 50, the main body 40 can be adjusted in angle so as to enable the aiming line 100 to be projected on a ball-hitting point indicator 18 of the top 17 of the putter head 16. When the ball-hitting point indicator 18 is located on the aiming line 100, the aiming line 100 is perpendicular to the ball-striking face 19 of the putter head 16. Upon completion of the adjustment described above, the locating member 50 is tightened again. The putter 10 is ready for use and the aiming line 100 is activated. When the switch 70 is turned off, the aiming line 100 can be activated by pressing the touch control press button 80. The aiming line 100 can be automatically regulated by a delay circuit which is added to the circuit board 46.

The aiming device of the present invention is mounted on the juncture of the shaft and the grip of a golf putter. As a result, the aiming device of the present invention is out of the sight of user of the golf putter, who can see only the putter head 16, the ball 110, and the hole 120. In other words, the user of the golf putter is not distracted or obstructed by the aiming device. The device of the present invention is relatively small in size and can be thus kept in the pocket or golf bag.

What is claimed is:

1. A aiming device to be used with a golf putter, said aiming device comprising:

a holding member having a C-shaped cross section and provided with an axial hole and a pivoting column, said holding member being detachably fastened with the golf putter such that said holding member embraces the shaft or grip of the golf putter;

a main body fastened pivotally with said pivoting column of said holding member such that said main body turns on said pivoting column acting as a pivot;

a locating member for locating said main body on said pivoting column;

a laser member disposed in said main body for projecting an aiming line on a projection surface;

a switch for turning said laser member on or off;

a power source disposed in said main body and connected with said laser member;

wherein said main body is provided with a touch control press button for starting said laser member;

wherein said main body is provided with a delay circuit to cooperate with said touch control press button; and wherein said pivoting column is provided in an outer wall thereof with a plurality of outer threads, and a top thereof with a through hole; wherein said main body is provided at a bottom thereof with a through hole, and a bolt which is received in said through holes of said main body and said pivoting column and is engaged with a locking member; and wherein said locating member is provided with a threaded hole which is engaged with said outer threads of said pivoting column.

2. The aiming device as defined in claim 1, wherein said pivoting column is provided in the top thereof with an arcuate protrusion which is provided at a center thereof with a pillar having said through hole; wherein said main body is provided in the bottom thereof with an arcuate recess receiving said arcuate protrusion of said pivoting column; wherein said locking member is provided in a bottom thereof with an arcuate recess in contact with the bottom of said main body; and wherein said through hole of the bottom of said main body is greater in outer diameter than said pillar of said pivoting column so as to enable said main body to turn on said pillar for 360 degrees and to enable said main body to be obliquely adjusted in angle.

3. The aiming device as defined in claim 1, wherein said locating member is located under an underside of said main body such that said locating member can be moved upwards to press against the underside of said main body.

4. A aiming device to be used with a golf putter, said aiming device comprising:

a holding member having a C-shaped cross section and provided with an axial hole and a pivoting column, said holding member being detachably fastened with the golf putter such that said holding member embraces the shaft or grip of the golf putter;

a main body fastened pivotally with said pivoting column of said holding member such that said main body turns on said pivoting column acting as a pivot;

a locating member for locating said main body on said pivoting column;

a laser member disposed in said main body for projecting an aiming line on a projection surface;

a switch for turning said laser member on or off;

a power source disposed in said main body and connected with said laser member;

wherein said main body is provided with a touch control press button for starting said laser member;

wherein said main body is provided with a delay circuit to cooperate with said touch control press button; and wherein said holding member has a small diametric end, and a large diametric end which is provided with a pliable portion having a free end having a retaining projection, said large diametric end further provided with a retaining member having a protrusion.

5. The aiming device as defined in claim 4, wherein said large diametric end of said holding member is provided in two sides thereof with a slot; and wherein said retaining member is provided with two arms which are movably received in said two slots of said large diametric end such that said retaining member moves back and forth on said holding member.

6. The aiming device as defined in claim 4, wherein said pivoting column is located on said small diametric end of said holding member.

7. The aiming device as defined in claim 4, wherein said main body is provided with a receiving slot; and wherein said power source comprises a battery case and a plurality of batteries held in said battery case whereby said battery case is removably disposed in said receiving slot of said main body.

8. The aiming device as defined in claim 7, wherein said batteries are mercury batteries which are partially jutted out of said battery case; wherein said main body is provided with a circuit board having two conductive pieces which are connected with said batteries; and wherein said switch and said laser member are connected with said circuit board.

9. The aiming device as defined in claim 7, wherein said receiving slot is provided with two depressions for receiving two support arms of a clamp whereby said two support arms are provided at a free end thereof with an inverted hook; and wherein said battery case is provided with two slots corresponding in location to said depressions whereby said two slots of said battery case are caught by said two inverted hooks of said two support arms of said clamp, so as to enable said clamp to take said battery case out of said receiving slot of said main body.

10. The aiming device as defined in claim 4, wherein said main body is provided with a receiving slot; and wherein said main body is provided with a receiving slot; and wherein said power source comprises a battery case and a plurality of batteries held in said battery case whereby said battery case is removably disposed in said receiving slot of said main body.

11. The aiming device as defined in claim 4, wherein said batteries are mercury batteries which are partially jutted out of said battery case; wherein said main body is provided with a circuit board having two conductive pieces which are connected with said batteries; and wherein said switch and said laser member are connected with said circuit board.

12. The aiming device as defined in claim 4, wherein said receiving slot is provided with two depressions for receiving two support arms of a clamp whereby aid two support arms are provided at a free end thereof with an inverted hook; and wherein said battery case is provided with two slots corresponding in location to said depressions whereby said two slots of said battery cases are caught by said two inverted hooks of said two support arms of said clamp, so as to enable said clamp to take said battery case out of said receiving slot of said main body.

* * * * *